US005379955A

United States Patent [19]

McGraw

[11] Patent Number: 5,379,955

[45] Date of Patent: Jan. 10, 1995

[54] INFEED HOPPER WITH PIVOTABLE THROAT FOR SHREDDER OR GRANULATOR

[75] Inventor: Peter S. McGraw, Severna Park, Md.

[73] Assignee: The United States of America as represented by the Secretary of the Navy, Washington, D.C.

[21] Appl. No.: 125,714

[22] Filed: Sep. 24, 1993

[51] Int. Cl.[6] ..... B02C 23/02

[52] U.S. Cl. ..... 241/186.2; 241/186.4; 241/224; 241/301

[58] Field of Search ..... 241/186.2, 186.4, 224, 241/301; 221/65, 208, 209, 272; 222/160, 163, 164, 167

[56] References Cited

U.S. PATENT DOCUMENTS

| | | | |
|---|---|---|---|
| 251,192 | 12/1881 | Cranson | 241/224 X |
| 464,184 | 12/1891 | Deissler et al. | 241/224 |
| 1,529,533 | 3/1925 | Zimmerman | 241/224 |
| 2,038,041 | 4/1936 | Gutman | 241/186.2 X |
| 2,505,624 | 4/1950 | Knight | 241/186.4 X |
| 2,764,361 | 9/1956 | Moore | 241/186.2 X |
| 3,618,865 | 11/1971 | Grundler et al. | 241/224 X |
| 4,205,798 | 6/1980 | Bang | 241/224 |
| 4,889,290 | 12/1989 | Koffsky | 241/224 X |

FOREIGN PATENT DOCUMENTS

| | | | |
|---|---|---|---|
| 2095579 | 10/1982 | United Kingdom | 241/224 |

*Primary Examiner*—Timothy V. Eley
*Attorney, Agent, or Firm*—Gary G. Borda

[57] ABSTRACT

An infeed hopper with a pivotable throat portion for feeding material into a processing device. The pivotable throat portion has a first position in which it guides feed material from an inlet of the infeed hopper toward the processing device, and is movable from the first position so as to move the feed material through an outlet of the infeed hopper toward the processing device, particularly for forcing jammed material into the processing device. In another position, the pivotable throat portion provides access into the processing device for cleaning and maintaining the processing device.

13 Claims, 2 Drawing Sheets

INFEED HOPPER WITH PIVOTABLE THROAT FOR SHREDDER OR GRANULATOR

BACKGROUND OF THE INVENTION

1. Field of the Invention

The present invention relates to a continuous feed hopper for a processing device, such as a shredder or granulator. More particularly, the present invention relates to an infeed hopper having a pivotable throat portion for forcing the feed material into the processing device. The pivotable throat also allows access into the processing device for cleaning and maintaining the operating parts.

2. Description of the Prior art

Presently, waste materials such as plastic, metal and glass are generated in large quantities, and must be processed for disposal. For example, U.S. Navy ships generate plastic waste at the rate of 0.1–0.2 pounds per man per day (0.045–0.09 Kg per man per day), and glass and metal at the rate of 0.54 pounds per man per day (0.24 Kg per man per day). The plastic, metal and glass wastes are usually of very low density, such as 1.4 pound per cubic foot (22.4 Kg per cubic meter) and 11.8 pound per cubic foot (189.0 Kg per cubic meter), respectively. In the past, such waste that is generated by Navy ships has generally been discharged at sea. However, because of adverse environmental impact, this practice has now been ended.

Processing devices for processing waste material are generally available. For example, Rapid Granulator, Inc., 5217 28th Avenue, P.O. Box 5887, Rockford, Ill. 61125 is one manufacturer of processing devices for processing waste material. Such devices are well known to persons of skill in the art, and, therefore, will not be described in detail here.

Processing waste material with existing technologies requires, in particular, that plastic waste having greatly varying density be pre-shredded to reduce the size of the material and to provide an infeed having a more consistent density. To increase the process rate of the shredder a continuous feed of waste is required into the shredder. Infeed hoppers are generally used as devices for shredders for continuously feeding material into processing devices, such as shredders.

The problem with most existing continuous feed devices for shredders is that the operator of the shredder is exposed to the cutters when they are operating so that projectiles broken off from the waste during the shredding process can be shot back at the operator. In addition, due to the low density of plastic waste that is fed into the shredder, the plastic waste sometimes needs to be forced down into the cutters of the shredder so that the waste does not stick in the hopper.

SUMMARY OF THE INVENTION

Accordingly, there is a need for a hopper that avoids the aforementioned shortcomings in the presently available devices for processing waste.

These and other objects of the present invention may be achieved by a hopper for feeding material to be processed into a processing device, the hopper having an inlet for receiving the material to be processed from outside the hopper; a feed path for guiding the material from the inlet toward the processing device; and an outlet for discharging the material from the feed path into the processing device, wherein the feed path has a movable section with a first position in which it guides the material from the inlet toward the processing device, and is movable from the first position for applying force to the material to force the material through the outlet toward the processing device.

According to a further aspect, the invention may comprise a combination of a processing device and the above-described feed hopper with a pivotable throat portion.

Other features and advantages of the present invention will become apparent from the following description of the invention which refers to the accompanying drawings.

DETAILED DESCRIPTION OF A PREFERRED EMBODIMENT OF THE INVENTION

Figure 1:
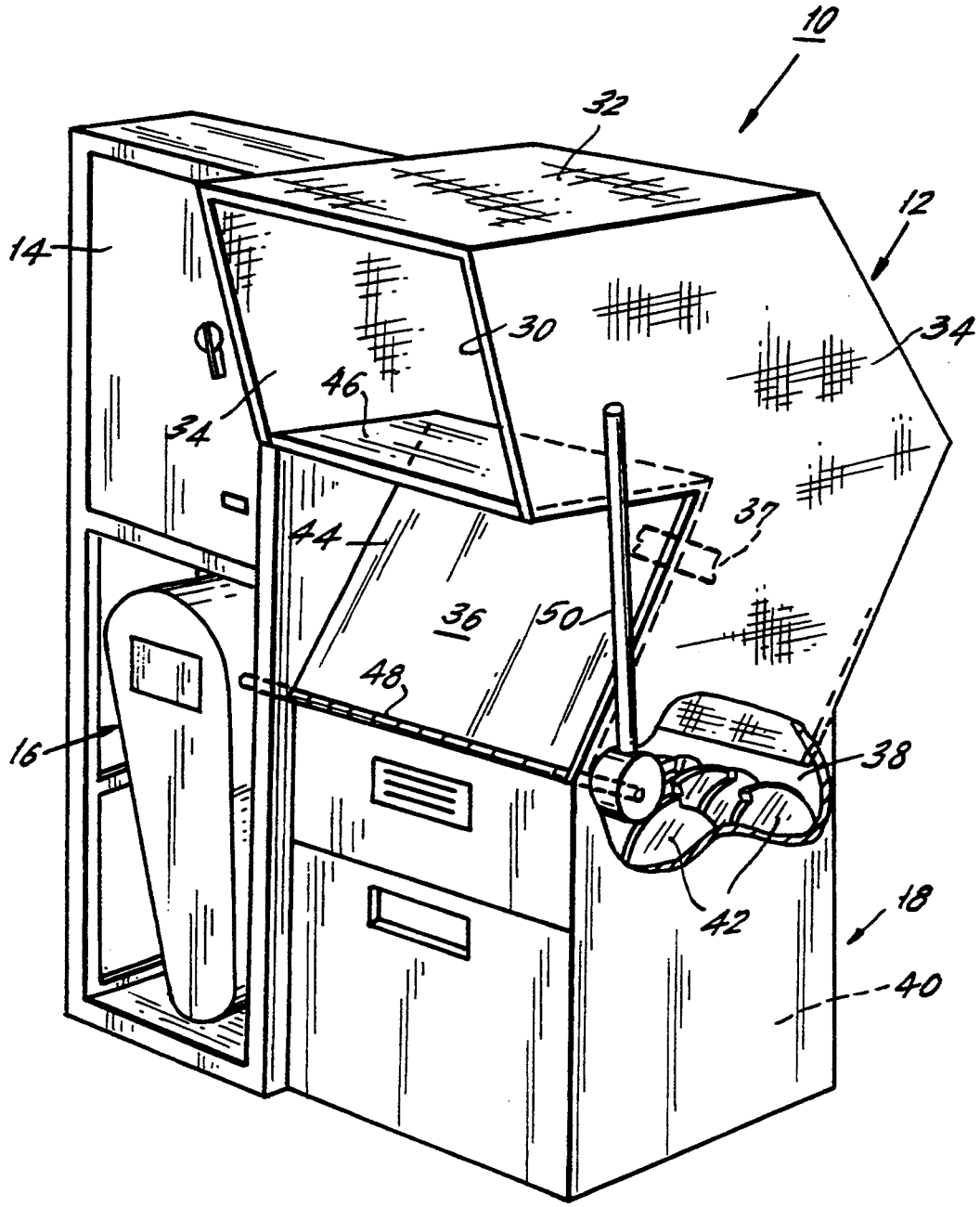
FIG. 1 is a perspective view of a processing apparatus having an infeed hopper according to a preferred embodiment of the present invention.

In FIG. 1, a processing apparatus 10 has an infeed hopper 12. The processing apparatus 10 also includes a control panel 14 and a drive mechanism 16 for driving the processing apparatus 10. The processing apparatus 10 could be, for example, a shredder or a granulator for shredding or granulating material that fed into the processing apparatus 10. However, the infeed hopper 12 of the present invention is not limited to such processing devices. The infeed hopper 12 may be used with any type of processing device that requires an infeed hopper for feeding in material into the processing device.

In FIG. 1, the infeed hopper 12 is shown attached to a shredder 18. The infeed hopper 12 has an inlet 30 for receiving material (not shown) that is to be processed in the shredder 18. The inlet 30 may be covered with a flexible curtain or a folding door (not shown) to prevent material from being expelled from the shredder 18 through the inlet 30. The infeed hopper 12 also functions so as to prevent material in the shredder 18 from being expelled out of the processing apparatus 10, as discussed below in further detail.

The infeed hopper 12 has fixed top and side walls 32, 34 that partially define the feed path for the material received in the infeed hopper 12 through the inlet 30. A pivotable throat portion 36 completes the structure of the infeed hopper 12 so as to form the feed path for the material fed into the infeed hopper 12. At the other end of the feed path formed by the fixed top and side walls 32, 34 and by the pivotable throat portion 36 is an outlet 38 for discharging the material from the infeed hopper 12 into the shredder 18.

Accordingly, the infeed hopper 12 feeds material received into the infeed hopper 12 at the inlet 30 out of the outlet 38 toward the shredder 18. The material discharged out of the outlet 38 is received in a cutting chamber 40 of the shredder 18. The cutting chamber 40 has cutting elements 42 for shredding and/or granulating the material received in the cutting chamber 40.

The fixed top and side walls 32, 34 of the infeed hopper 12 may be made of any suitable material. Perforated sheet or wire mesh may be used to allow gases to escape from the cutting chamber 40. The fixed top and side walls 32, 34 may be attached to the outer housing of the shredder 18 by any suitable or desired method, such as by welding or by forming the fixed top and side walls 32, 34 of the hopper 12 as extensions of the walls of the housing of the shredder 18. The pivotable throat portion 36 may be made from any suitable or desired material.

The pivotable throat portion 36 has a lower portion 44, which is pivotably attached at one end to the outer housing of the shredder 18, and an upper portion 46, which extends from the other end of the lower portion 44 at an angle corresponding to the shape of the infeed hopper 12. The pivotable throat portion 36 can be attached to the shredder 18 by any suitable arrangement. In FIG. 1, the lower portion 44 is connected by a conventional hinge 48 with the housing of the shredder 18.

As shown in FIG. 1, the pivotable throat portion 36 has the cross-sectional shape of a "figure-7". A pivotable throat portion of any shape may be provided, which is suitable or desired for the processing apparatus with which the pivotable throat portion is to be used. The preferred pivoting arrangement is not strictly necessary, but could be replaced by another movement pattern if desired, although the pivotal structure is believed to be the most efficient and economical.

The pivotable throat portion 36 is shaped so as to fit, along its side edges, between the side walls 34 of the infeed hopper 12 so as to form the bottom for the feed path for directing the feed material from the inlet 30 to the outlet 38. The pivotable throat portion 36 fits with the side walls 34 so that material in the infeed hopper 12 is prevented from falling out of the infeed hopper 12 from between the side walls 34 and the pivotable throat portion 36. Therefore, the shape of the pivotable throat portion 36 may be selected so as to form an appropriate fit with the side walls 34 of the infeed hopper 12.

Moreover, the shape of the pivotable throat portion 36 is selected so that the lower portion 44 forms a barrier to material that may be expelled by the shredder 18 during its operation. As shown in FIG. 1, the lower portion 44 obstructs the path of any material that may be thrown back by the cutting elements 42 thereby preventing injury to the operator, particularly, but not exclusively, if the cutters rotate in the direction of the operator. In this manner, the pivotable throat portion of the present invention solves one of the shortcomings in the continuous feed devices of the prior art.

In operation, the processing apparatus 10 shown in FIG. 1 shreds plastic, metal and glass material to increase the density of the material and to open any containers that could trap air, thereby making them difficult to sink. For example, when used to process waste material generated by Navy ships, all plastic, metal and glass containers are shredded prior to being discharged overboard or ashore in accordance with existing regulations.

Figure 2:
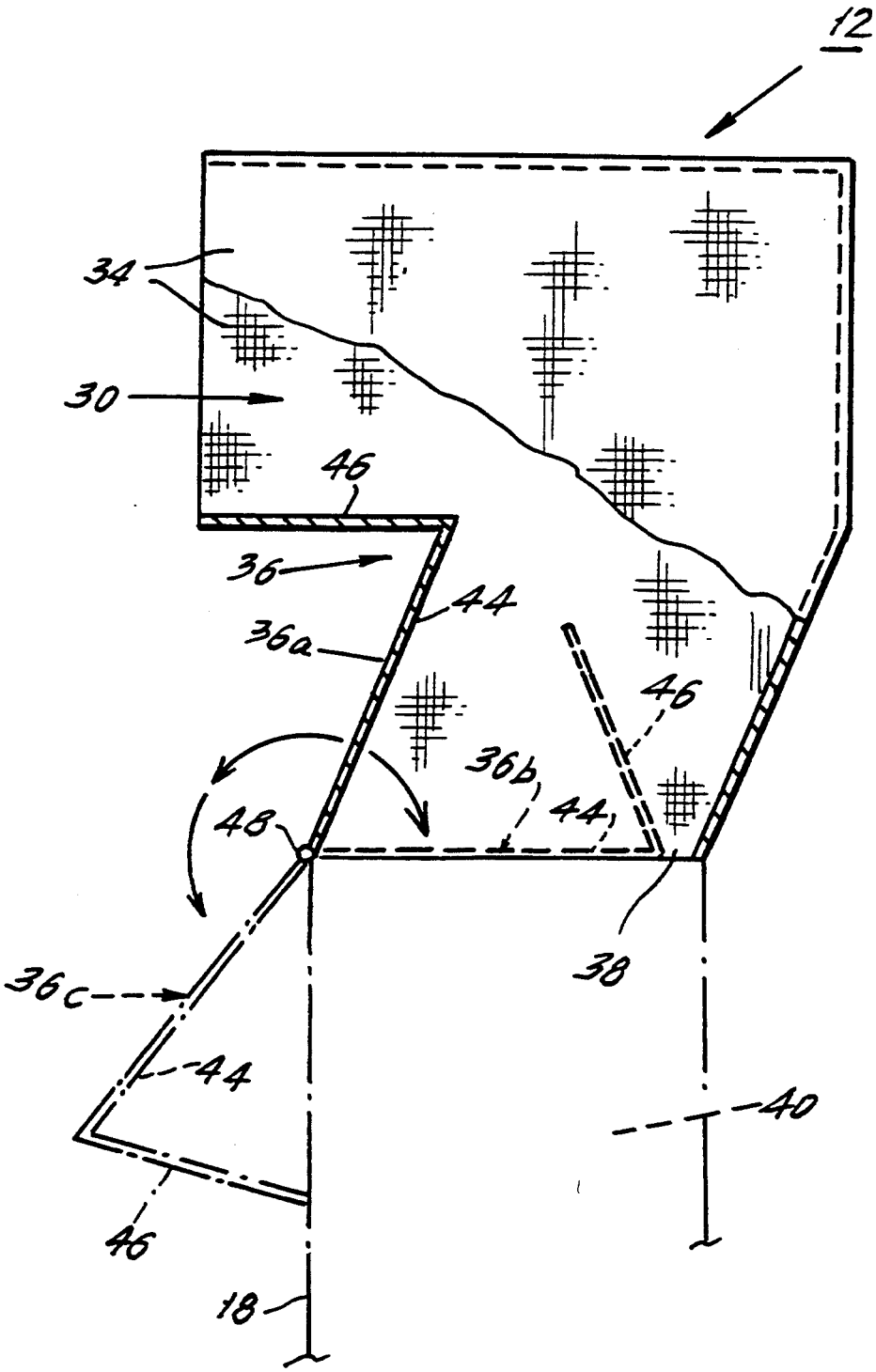
FIG. 2 is a schematic side view of the infeed hopper of FIG. 1.

During operation of the processing apparatus 10, the pivotable throat portion 36 has a first position designated as 36*a* in FIG. 2. At position 36*a*, the pivotable throat portion 36 directs the material fed into the infeed hopper 12 at the inlet 30 to the outlet 38 for discharge into the cutting chamber 40 of the shredder 18.

The pivotable throat portion 36 can be moved from the first position 36*a* to a second position 36*b* (shown with broken lines in FIG. 2) at which the pivotable throat portion 36 is used for applying force to any material that has been fed into the infeed hopper 12 and become stuck above the cutting chamber 40, so as to move the material through the outlet 38 toward the cutting chamber 40 for being shredded. When the pivotable throat portion 36 is moved to its second position 36*b*, the upper portion 46 of the pivotable throat portion 36 forms a shield that prevents material in the cutting chamber 40 from being expelled through the infeed hopper 12 toward the person operating the processing apparatus 10.

Accordingly, in addition to defining, in its first position 36*a*, the feed path of the material fed into the infeed hopper 12 through the inlet 30, the pivotable throat portion 36 can also be used for applying force to the feed material to move the material through the outlet 38 by moving the pivotable throat portion 36 to its second position 36*b*. In each position, the pivotable throat portion 36 forms a barrier for preventing flying waste that could be thrown back from the cutting elements 42 from being expelled from the infeed hopper 12 at the operator.

Therefore, moving the pivotable throat portion 36 from position 36*a* to 36*b* forces the feed material onto the cutting elements 42 while continually protecting the operator from flying waste. If additional waste is added when the pivotable throat portion 36 is in position 36*b*, which is not a proper operating mode, the waste will drop out of the processing apparatus 10 onto the floor.

The pivotable throat portion 36 may also be moved to a third position 36*c* (shown with broken lines in FIG. 2) at which the operator can obtain access to the inner operating parts of the shredder 18. The pivotable throat portion 36 may preferably include a conventional mechanical or electrical interlocking arrangement (shown schematically at 37 in FIG. 1), so as to prevent its movement from position 36*a* to 36*c* while the cutting elements 42 are moving. When located in position 36*c* the pivotable throat portion 36 allows easy access to the top of the cutting elements 42 and into the cutting chamber 40 for cleaning and maintenance of the shredder 18.

The pivotable throat portion 36 may be moved between the various positions 36*a*, 36*b* and 36*c* by a lever 50. The lever 50 may be connected with the hinge 48 of the pivotable throat portion 36 so that by moving the lever 50 back and forth the pivotable throat portion can be moved between its various positions 36*a*–36*c*. Any suitable or desired arrangement for connecting the lever 50 with the pivotable throat portion 36 may be used so that the pivotable throat portion 36 can be moved between its various positions 36*a*–36*c*. Alternatively, a handle (not shown) could be provided attached to the pivotable throat portion 36 to move it from one position to another.

A clutch arrangement (not shown) may also be provided to retain the pivotable throat portion 36 at its respective positions. For example, a spring-loaded clutch may be provided to control the operation of the pivotable throat portion 36. Alternatively, a detent arrangement (not shown) may be provided to retain the pivotable throat portion 36. Such arrangements are well known to persons skilled in the art and, therefore, will not be discussed in detail here.

The infeed hopper for processing devices according to the present invention has a combination of benefits. The geometry of the pivotable throat portion 36, in its nominal position 36*a*, allows for continuously feeding material into the processing apparatus 10 while always protecting the operator from feed material that could be expelled or thrown back by the cutting elements 42. The geometry of the pivotable throat portion 36 is a key feature to the versatility of this device. Standard hoppers may offer some protection to flying debris via shields and guards, but they do not offer the ability to force the feed material into the cutting elements. The ability to drive the feed material into the cutting chamber, particularly, but not exclusively, if the material has become stuck, allows the operator to process feed material of much larger size than normal. An added feature of the pivotable throat portion that allows it to rotate out, when the processing unit is secured, permits unparalleled access to the cutting chamber.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A hopper for feeding material to be processed into a processing device, said hopper comprising:

an inlet for receiving the material to be processed from outside said hopper;

a feed path for guiding the material from said inlet toward the processing device; and an outlet for discharging the material from said feed path into the processing device, wherein said feed path has a movable section, said movable section including a pivotable throat portion of said feed path, said pivotable throat portion having a first position in which it guides the material from said inlet toward the processing device, said pivotable throat portion being movable from said first position to a second position for applying force to the material to force the material through said outlet toward the processing device, and further wherein said feed path includes a top wall and side walls, said top wall being spaced away from said pivotable throat portion, said side walls extending substantially at right angles from side edges of said top wall to said pivotable throat portion so that said pivotable throat portion extends between lower ends of said side walls such that said top wall, side walls and pivotable throat portion together defining said feed path from said inlet to said outlet for material fed into said inlet.

2. The hopper of claim 1, wherein said pivotable throat portion is pivotable to a third position for providing access into the processing device through said outlet of said hopper.

3. The hopper of claim 2, further comprising a lever connected to said pivotable throat portion for moving said pivotable throat portion from said first position for guiding material from said inlet toward the processing device to said second position for applying force to the material, and from said first position to said third position for providing access into the processing device.

4. The hopper of claim 2, further comprising an interlocking means for preventing said pivotable throat portion from moving from said first position to said third position when processing elements of the processing device are moving.

5. The hopper of claim 1, further comprising a lever connected to said pivotable throat portion for moving said pivotable throat portion from said first position.

6. The hopper of claim 1, wherein said hopper includes means for preventing material fed into said hopper from being expelled out of said inlet.

7. The hopper of claim 1, wherein said hopper opens into the processing device at said outlet of said hopper;

said pivotable throat portion has a lower portion wherein a first end of said lower portion is pivotally attached to another portion of said feed path near said outlet so that said lower portion extends upwardly and inwardly from the processing device when said pivotable throat portion is in said first position; and said pivotable throat portion has an upper portion, said upper portion extending outwardly from a second end of said lower portion opposite to said first end;

said upper portion forming an angle with said lower portion so as form a shield between the processing device and said inlet of said hopper when force is applied to the material thereby preventing the material in the processing device from being expelled from the processing device out of said hopper through said inlet.

8. The hopper of claim 7, wherein said side walls extend away generally at right angles from side edges of said upper and lower portions of said pivotable throat portion, and said top wall joining ends of said side walls with said top wall being at a position spaced away from said pivotable throat portion.

9. The hopper of claim 7, wherein said angle between said upper and said lower portion of said pivotable throat portion is an acute angle.

10. The hopper of claim 7, wherein said lower portion is pivotally attached by a hinge arrangement to the processing device.

11. In combination, a hopper and an apparatus for processing material, wherein said hopper comprises:

an inlet for receiving the material to be processed from outside the hopper;

a feed path for guiding the material from said inlet toward the processing device; and an outlet for discharging the material from said feed path into the processing device, wherein said feed path has a movable section, said movable section including a pivotable throat portion of the feed path, said pivotable throat portion having a first position in which it guides the material from said inlet toward the processing device, and said pivotable throat portion being movable from said first position to a second position for applying force to the material to force the material through said outlet toward the processing device, and further wherein said feed path includes a top wall and side walls, said top wall being spaced away from said pivotable throat portion, said side walls extending substantially at right angles from side edges of said top wall to said pivotable throat portion so that said pivotable throat portion extends between lower ends of said side walls such that said top wall, side walls and pivotable throat portion together defining said feed path from said inlet to said outlet for material fed into said inlet; and wherein said apparatus for processing material has an inlet for receiving material for processing, said outlet of said hopper opening into said inlet of said apparatus for processing material.

12. The combination of claim 11, wherein said processing apparatus includes means for processing material fed into said apparatus, said means for processing being selected from the group consisting of shredders and granulators.

13. The combination of claim 11, wherein said apparatus is capable of processing one or more material selected from the group consisting of plastic, metal and glass.

* * * * *